US010859077B2

(12) United States Patent
Mou et al.

(10) Patent No.: US 10,859,077 B2
(45) Date of Patent: Dec. 8, 2020

(54) MINIATURE GAS CONTROL DEVICE

(71) Applicant: Microjet Technology Co., Ltd., Hsinchu (TW)

(72) Inventors: Hao-Jan Mou, Hsinchu (TW); Hung-Hsin Liao, Hsinchu (TW); Shih-Chang Chen, Hsinchu (TW); Jia-Yu Liao, Hsinchu (TW); Shou-Hung Chen, Hsinchu (TW); Yung-Lung Han, Hsinchu (TW); Wei-Ming Lee, Hsinchu (TW)

(73) Assignee: MICROJET TECHNOLOGY CO., LTD., Hsinchu (TW)

( * ) Notice: Subject to any disclaimer, the term of this patent is extended or adjusted under 35 U.S.C. 154(b) by 125 days.

(21) Appl. No.: 16/043,540

(22) Filed: Jul. 24, 2018

(65) Prior Publication Data

US 2019/0055934 A1 Feb. 21, 2019

(30) Foreign Application Priority Data

Aug. 21, 2017 (TW) ..... 106128263 A

(51) Int. Cl.
*F04B 35/04* (2006.01)
*F04B 39/10* (2006.01)
(Continued)

(52) U.S. Cl.
CPC ..... *F04B 35/04* (2013.01); *F04B 39/10* (2013.01); *F04B 43/046* (2013.01); *F04B 45/047* (2013.01); *F04B 53/20* (2013.01)

(58) Field of Classification Search
CPC ..... F04B 35/04; F04B 39/10; F04B 43/046; F04B 45/047; F04B 53/20
(Continued)

(56) References Cited

U.S. PATENT DOCUMENTS

2004/0079637 A1* 4/2004 Maeno ..... G01N 27/403 204/431
2004/0155211 A1 8/2004 Takeda et al.
(Continued)

FOREIGN PATENT DOCUMENTS

CN 1286893 A 3/2001
CN 201600350 U 10/2010
(Continued)

OTHER PUBLICATIONS

English Translation of DE-102012101861-A1 (Year: 2020).*
(Continued)

*Primary Examiner* — Connor J Tremarche
(74) *Attorney, Agent, or Firm* — Birch, Stewart, Kolasch & Birch, LLP

(57) ABSTRACT

A miniature gas control device is disclosed and includes a miniature gas transportation device and a miniature valve device. The miniature gas transportation device includes a protective film, a gas inlet plate, a resonance plate and a piezoelectric actuator stack sequentially. The miniature valve device includes a gas collecting plate, a valve film and a gas outlet plate stacked sequentially. By driving the piezoelectric actuator of the miniature gas transportation device, the gas flows into the miniature gas transportation device from the gas inlet plate, then the gas flows into the miniature valve device through the resonance plate, and the valve opening of the valve film is selectively opened or closed in response to a direction of the gas unidirectionally flowing among the perforations and chambers of the gas collection plate and the gas outlet plate, so as to perform a pressurizing operation and a pressure-releasing operation selectively.

14 Claims, 12 Drawing Sheets

(51) Int. Cl.

| | |
|---|---|
| ***F04B 53/20*** | (2006.01) |
| ***F04B 45/047*** | (2006.01) |
| ***F04B 43/04*** | (2006.01) |

(58) Field of Classification Search
USPC ..... 417/413.2
See application file for complete search history.

(56) References Cited

U.S. PATENT DOCUMENTS

| | | | | |
|---|---|---|---|---|
| 2008/0170951 | A1 | 7/2008 | Satoh | |
| 2011/0069855 | A1* | 3/2011 | Tokuda | H04M 1/03 381/334 |
| 2013/0071269 | A1 | 3/2013 | Fujisaki et al. | |
| 2013/0113337 | A1* | 5/2013 | Kasai | G01H 11/08 310/319 |
| 2014/0377099 | A1* | 12/2014 | Hsueh | F04B 43/046 417/413.2 |
| 2015/0035903 | A1* | 2/2015 | Zuo | B41J 2/161 347/44 |
| 2015/0172798 | A1* | 6/2015 | Chao | H04M 1/18 381/334 |
| 2016/0075838 | A1* | 3/2016 | Watanabe | D01F 6/32 521/55 |

FOREIGN PATENT DOCUMENTS

| | | | | |
|---|---|---|---|---|
| CN | 104235438 | A | 12/2014 | |
| CN | 205507651 | U | 12/2014 | |
| CN | 107023459 | A | 8/2017 | |
| DE | 102012101861 | A1 * | 9/2013 | F04B 19/006 |
| EP | 0587912 | A1 | 3/1994 | |
| EP | 2107243 | A2 | 10/2009 | |
| EP | 2107246 | A2 | 10/2009 | |
| EP | 3203074 | A1 | 8/2017 | |
| JP | 2001-115969 | A | 4/2001 | |
| JP | 2009-103111 | A | 5/2009 | |
| JP | 2013-245649 | A | 12/2013 | |
| KR | 10-2017-0091001 | A | 8/2017 | |
| TW | M528306 | U | 9/2016 | |
| TW | M538545 | U | 3/2017 | |
| TW | M540933 | U | 5/2017 | |
| TW | M542099 | U | 5/2017 | |

OTHER PUBLICATIONS

Extended European Search Report, dated Oct. 17, 2018, for European Application No. 18185119.7.
Chinese Office Action and Search Report dated Aug. 8, 2019, for corresponding Chinese Application No. 201710718362.8.
Indian Office Action, dated Feb. 25, 2020, for Indian Applcation No. 201824028070, along with an English translation.

* cited by examiner

MINIATURE GAS CONTROL DEVICE

FIELD OF THE INVENTION

The present invention relates to a gas transportation device, and more particularly to a miniature gas transportation device for a miniature gas control device with miniature, silent, waterproof and dustproof efficacy.

BACKGROUND OF THE INVENTION

With the advancement of science and technology, gas transportation devices used in many sectors such as pharmaceutical industries, computer techniques, printing industries or energy industries are developed toward elaboration and miniaturization. The gas transportation devices are important components that are used in for example miniature pumps, miniature atomizers, printheads or industrial printers. Therefore, it is important to provide an improved structure of the gas transportation device.

For example, in the pharmaceutical industries, control devices or control machines use motors and pressure valves to transfer gases. However, due to the volume limitations of the motors and the pressure valves, the control devices or the control machines are bulky in volume. In other words, the conventional control device fails to meet the miniaturization requirement, and is not suitable to be installed in or cooperate with a portable equipment. Moreover, during operations of the motor and the pressure valve, annoying noise is readily generated. It leads to inconvenience and discomfort in use.

However, since the conventional motors and pressure valves are not waterproof, some problems occur. If moisture or liquid is introduced into the motors and pressure valves during the process of transferring the gas, the outputted gas contains moisture. In case that the gas containing moisture is used to remove heat from the electronic components or the precision instruments, the electronic components or the precision instruments are possibly damped, rusted or even damaged. Also, the components within the conventional motors and pressure valves are possibly damped, rusted or damaged. Moreover, the conventional motors and pressure valves are not dustproof. If dust is introduced into the interior of the motors and pressure valves during the process of transferring the gas, the components are possibly damaged and the gas transportation efficiency is reduced.

Therefore, there is a need of providing a miniature gas control device to make the apparatus or the equipment utilizing the conventional gas transportation device to achieve a small-size, miniature, silent, portable and comfortable benefits in order to eliminate the above drawbacks.

SUMMARY OF THE INVENTION

An object of the present disclosure provides a miniature gas transportation device for use with a portable or wearable equipment or machine. While the gas fluctuation is generated by the high frequency operation of the piezoelectric plate, a pressure gradient is generated in the designed flow channels and the gas can flow at a high speed therein. Moreover, since there is an impedance difference between the feeding direction and the exiting direction of the flow channels, the gas can be transmitted from the inlet side to the outlet side. It benefits to solve the problems that the apparatus or equipment utilizing the conventional gas transportation device has a large volume, is difficult to be thinned, fails to achieve the purpose of portability, and has loud noises.

Another object of the present disclosure provides a waterproof and dustproof miniature gas transportation device. By being equipped with a protective film to filter out the moisture and the dust, it benefits to solve the problems that while the moisture or the dust is introduced into the conventional gas transportation device during the process of transferring the gas, the components are possibly damaged and the gas transportation efficiency is reduced.

In accordance with an aspect of the present invention, a miniature gas control device is provided. The miniature gas control device includes a miniature gas transportation device and a miniature valve device. The miniature gas transportation device includes at least one protective film, a gas inlet plate, a resonance plate and a piezoelectric. The at least one protective film having a waterproof and dustproof film structure allowing gas to pass therethrough. The gas inlet plate includes at least one inlet. The at least one protective film, the gas inlet plate, the resonance plate and the piezoelectric actuator are stacked on each other sequentially, and a gap is formed between the resonance plate and the piezoelectric actuator to define a first chamber. When the piezoelectric actuator is actuated, the gas is fed into the miniature gas transportation device through the at least one inlet of the gas inlet plate, transferred through the resonance plate, introduced into the first chamber, and further transferred. The miniature valve device includes a gas collecting plate, a valve film and a gas outlet plate. The gas collecting plate includes at least two perforations and at least two chambers. The valve film includes a valve opening. The gas outlet plate includes at least two perforations and at least two chambers. The gas collecting plate, the valve film and the gas outlet plate are stacked on each other sequentially and a gas-collecting chamber is defined by the miniature gas transportation device and the miniature valve device. After the gas is transferred from the miniature gas transportation device to the gas-collecting chamber and fed into the miniature valve device, the gas flows unidirectionally in the at least two perforations and at least two chambers of the gas collecting plate, and at least two perforations and at least two chambers of the gas outlet plate, respectively. The valve opening of the valve film is opened or closed in response to a direction of the flow of the gas in the miniature valve device, so that a pressurizing operation and a pressure-releasing operation is selectively performed.

The above contents of the present invention will become more readily apparent to those ordinarily skilled in the art after reviewing the following detailed description and accompanying drawings, in which:

DETAILED DESCRIPTION OF THE PREFERRED EMBODIMENT

Figure 1A:
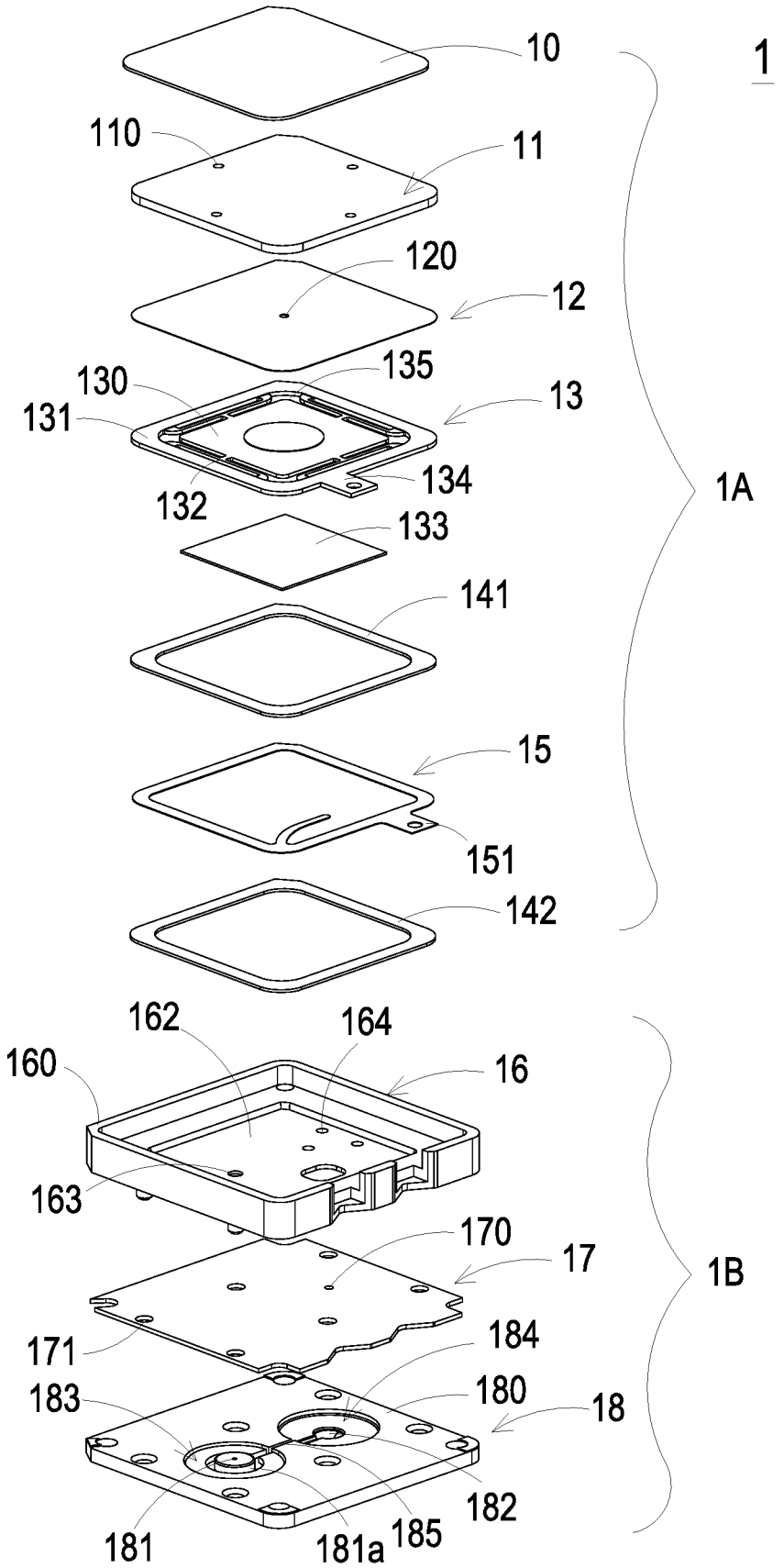
FIG. 1A is a schematic exploded view illustrating a miniature gas control device according to an embodiment of the present invention and taken along a first viewpoint.

The present disclosure will now be described more specifically with reference to the following embodiments. It is to be noted that the following descriptions of preferred embodiments of this disclosure are presented herein for purpose of illustration and description only. It is not intended to be exhaustive or to be limited to the precise form disclosed.

Please refer to FIGS. 1A, 1B, 2A and 2B. The present discourse provides a miniature gas control device 1 including at least one miniature gas transportation device 1A, at least one protective film 10, at least one gas inlet plate 11, at least one inlet 110, at least resonance plate 12, at least one piezoelectric actuator 13, at least one gap g0, at least one first chamber 121, at least one miniature valve device 1B, at least one gas collecting plate 16, at least one valve film 17, at least one valve opening 170, at least one gas outlet 18, at least one gas-collecting chamber 162. The number of the miniature gas transportation device 1A, the gas inlet plate 11, the resonance plate 12, the piezoelectric actuator 13, the gap g0, the first chamber 121, the miniature valve device 1B, the gas collecting plate 16, the valve film 17, the valve opening 170, the gas outlet plate 18 and the gas-collecting chamber 162 is exemplified by one for each in the following embodiments but not limited thereto. It is noted that each of the miniature gas transportation device 1A, the gas inlet plate 11, the resonance plate 12, the piezoelectric actuator 13, the gap g0, the first chamber 121, the miniature valve device 1B, the gas collecting plate 16, the valve film 17, the valve opening 170, the gas outlet plate 18 and the gas-collecting chamber 162 can also be provided in plural numbers.

Figure 1B:
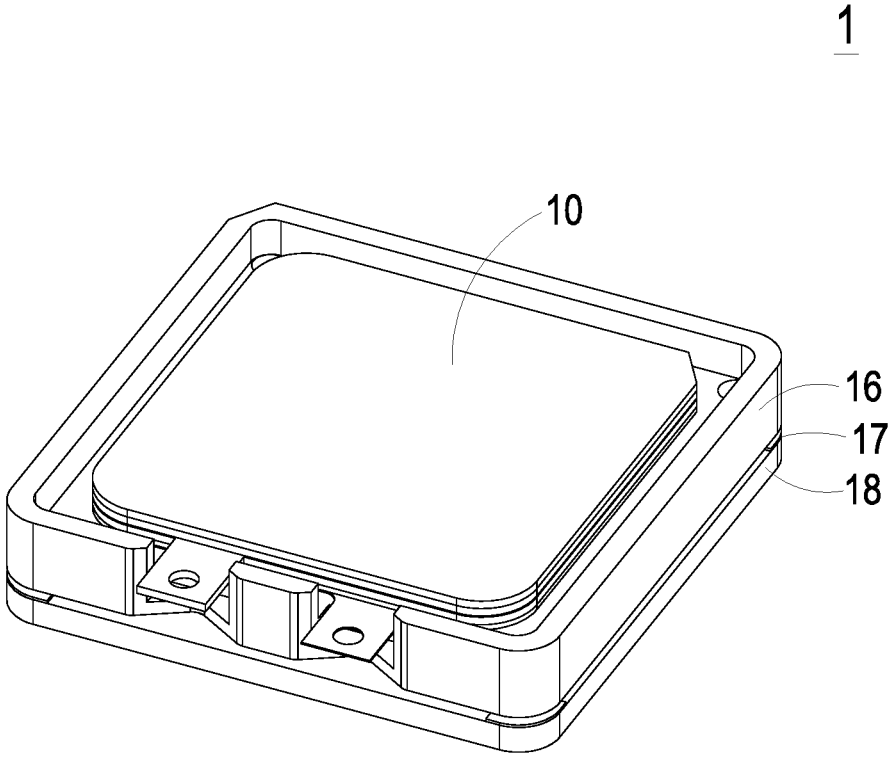
FIG. 1B is a schematic assembled view illustrating the miniature gas control device of FIG. 1A.
Figure 2A:
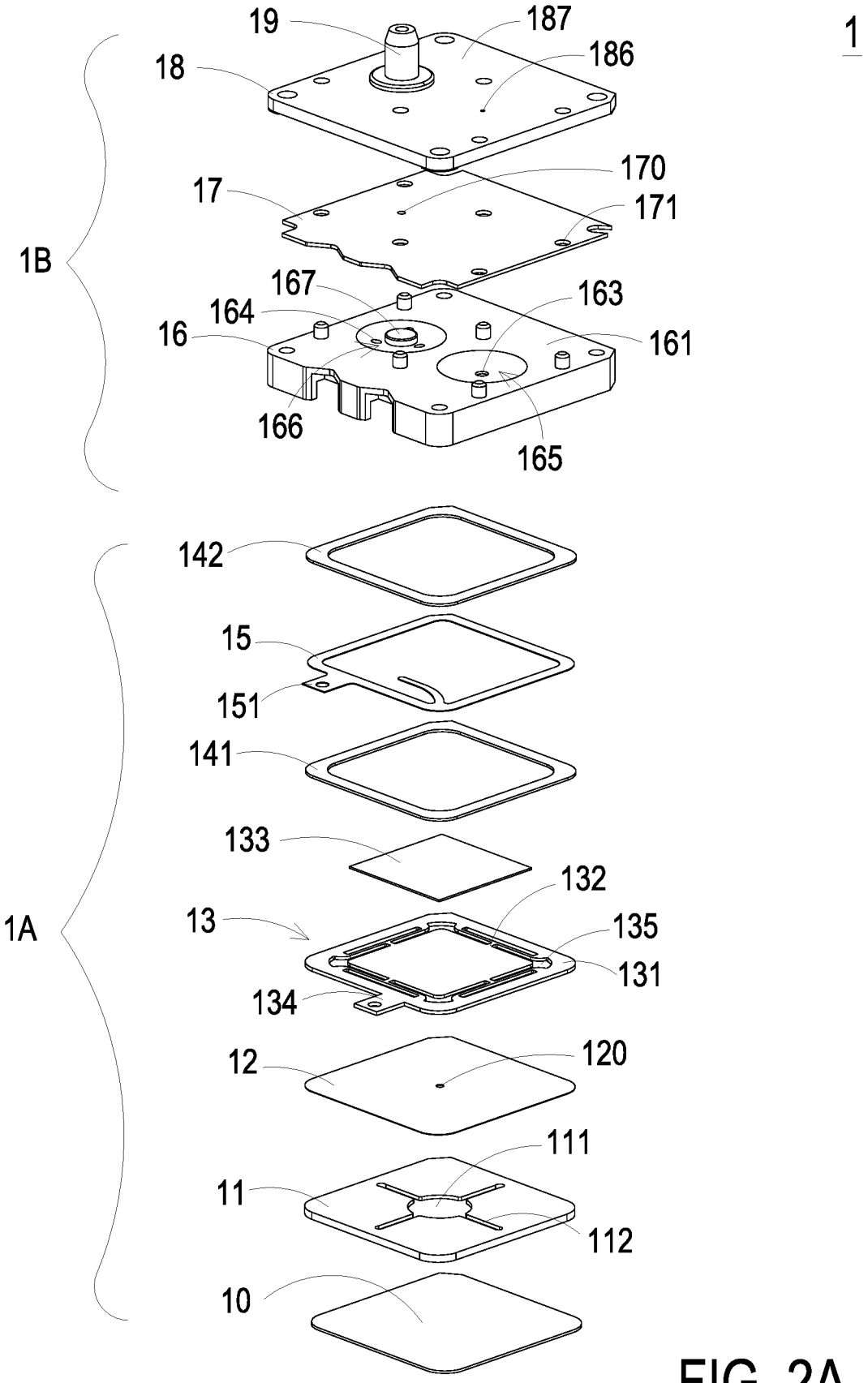
FIG. 2A is a schematic exploded view illustrating the miniature gas control device according to the embodiment of the present invention and taken along a second viewpoint.
Figure 2B:
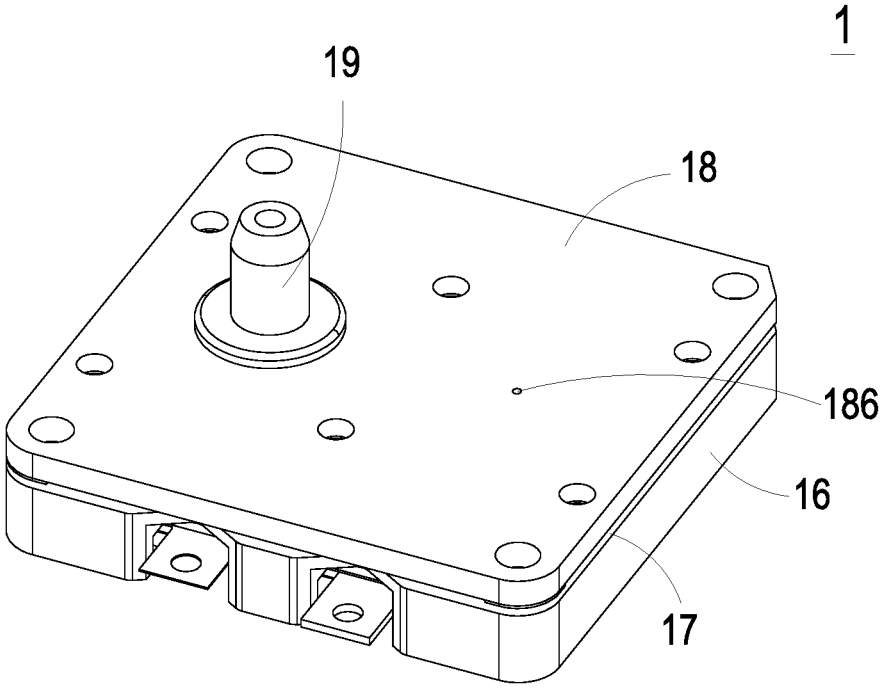
FIG. 2B is a schematic assembled view illustrating the miniature gas control device of FIG. 2A.

The present disclosure provides a miniature gas control device. The miniature gas control device may be used in many sectors such as pharmaceutical industries, energy industries, computer techniques or printing industries for transporting gases, but not limited thereto. Please refer to FIGS. 1A, 1B, 2A and 2B. FIG. 1A is a schematic exploded view illustrating a miniature gas control device according to an embodiment of the present invention and taken along a first viewpoint. FIG. 1B is a schematic assembled view illustrating the miniature gas control device of FIG. 1A. FIG. 2A is a schematic exploded view illustrating the miniature gas control device according to the embodiment of the present invention and taken along a second viewpoint. FIG. 2B is a schematic assembled view illustrating the miniature gas control device of FIG. 2A. As shown in FIGS. 1A and 2A, the miniature gas control device 1 includes a miniature gas transportation device 1A and a miniature valve device 1B. In this embodiment, the miniature gas transportation device 1A includes a protective film 10, a gas inlet plate 11, a resonance plate 12, a piezoelectric actuator 13, a first insulation plate 141, a conducting plate 15 and a second insulation plate 142. The protective film 10, the gas inlet plate 11, the resonance plate 12, the piezoelectric actuator 13, the first insulation plate 141, the conducting plate 15 and the second insulation plate 142 are stacked on each other sequentially to be assembled as the miniature gas transportation device 1A. In the embodiment, the protective film 10 is attached on an outward surface of the gas inlet plate 11. The piezoelectric actuator 13 includes a suspension plate 130 and a piezoelectric ceramic plate 133, and is disposed corresponding to the resonance plate 12, but not limited thereto.

Please refer to FIGS. 1A, 1B, 2A and 2B. In this embodiment, the miniature valve device 1B includes a gas collecting plate 16, a valve film 17 and a gas outlet plate 18. The gas collecting plate 16, the valve film 17 and the gas outlet plate 18 are stacked on each other sequentially, but not limited thereto. The gas collecting plate 16 may have a single plate structure, or in this embodiment, may have a frame structure having a bottom plate 169 with sidewalls 168 protruding from the edges thereof. The bottom plate 169 and the sidewalls 168 of the gas collecting plate 16 collaboratively define an accommodation space 16*a*. Referring to FIG. 1B, there is shown the miniature gas control device 1 in an assembled state, taken from the front side. As shown in FIG. 1B, the miniature gas transportation device 1A is accommodated in the accommodation space 16*a*. Meanwhile, the valve film 17 and the gas outlet plate 18 are sequentially stacked and disposed under the gas collecting plate 16. Referring to FIG. 2B there is shown the miniature gas control device in the assembled state, taken from the rear side. As shown in FIG. 2B, the gas outlet plate 18 has a pressure-releasing perforation 186 and an outlet structure 19. The outlet structure 19 is adapted to be in communication with an inner space of a target equipment (not shown), and the pressure-releasing perforation 186 is adapted to discharge the gas inside the miniature valve device 1B for pressure relief. After the miniature gas transportation device 1A and the miniature valve device 1B are assembled, gas is introduced into the miniature gas transportation device 1A through at least one inlet 110 of the gas inlet plate 11, and the gas is driven by the operation of the piezoelectric actuator 13 to flow through plural pressure chambers (not shown) and be transferred downwardly in a transportation direction. As a result, the gas flows in a one-way direction inside the miniature valve device 1B, and accumulates pressure in the target equipment (not shown), which is connected with the output structure 19 of the miniature valve device 1B. When it is needed to release the gas pressure in the target equipment, the quantity of the gas transferred from the miniature gas transportation device 1A to the miniature valve device 1B is adjusted to make the gas discharged through the pressure-releasing perforation 186 of the gas outlet plate 18. Hence, the gas-releasing operation is performed.

Please refer to FIGS. 1A and 2A again. As shown in FIG. 1A, the gas inlet plate 11 of the miniature gas transportation device 1 includes at least one inlet 110. In the embodiment, the number of the inlets 110 is exemplified by but not limited thereto four inlets 110. The number of the inlets 110 can be varied according to the practical requirements. In response to the action of the atmospheric pressure, the gas is introduced into the miniature gas transportation device 1A through the inlets 110. As shown in FIG. 2A, a central cavity 1 and at least one convergence channel 112 are formed on the bottom surface of the gas inlet plate 11, wherein the bottom surface of the gas inlet plate is opposing to the inlet 110. In the embodiment, the number of the convergence channel 112 is exemplified by four but not limited thereto. The four convergence channels 112 are formed corresponding to and in communication with the four inlets 110 disposed on the top surface of the gas inlet plate 11, respectively, so as to introduce the gas entered from the inlets 110 to the central cavity 111 for further downward transportation. In this embodiment, the at least one inlet 110, the at least one convergence channel 112 and the central cavity 111 of the gas inlet plate 11 are integrally formed from a single structure. The central cavity 111 is located at the intersection of the four convergence channels 112 that forms a convergence chamber for temporarily storing the gas converged thereto. In some embodiments, the gas inlet plate 11 is made of stainless steel, but not limited thereto. In some embodiments, the depth of the convergence chamber is equal to the depth of the at least one convergence channel 112, but not limited thereto.

Please refer to FIGS. 1A, 1B and 2A. As shown, the protective film 10 is attached on the top surface of the gas inlet plate 11 and completely covers the four inlets 110 of the gas inlet plate 11, but not limited thereto. The protective film 10 is a waterproof and dustproof film structure only allowing gas to pass therethrough. When the miniature gas transportation device 1A is enabled to transport the gas, the gas passes through the protective film 10 to be introduced into the inlets 110, in which the moisture and the dust contained in the gas are removed by the protective film 10. Thus, it prevents the inner components of the miniature gas transportation device 1A from the damage and the rusty caused by the moisture or the accumulated dust. Also, the efficiency of gas transportation is improved. Moreover, due to the arrangement of the protective film 10, the miniature gas transportation device 1A can output the gas without the moisture and the dust, so as to prevent the components contacted with the output gas from the damage of the moisture or the dust. In this embodiment, the protective film 10 complies with the Rating IP64 of International Protection Marking (IEC 60529), i.e., Dust protection level 6 (Complete protection, No ingress of dust) and Water protection level 4 (Protection against splashing of water: Water splashing against the enclosure from any direction shall have no harmful effect). In another embodiment, the protective film 10 complies with the Rating IP68 of International Protection Marking (IEC 60529), i.e., Dust protection level 6 and Water protection level 8 (Continuous immersion in water produces no harmful effects). The present disclosure is not limited thereto. In some embodiments, the miniature gas transportation device 1A may include a plurality of protective films 10, and the size of each protective film 10 is corresponding to the size of single inlet 110. Consequently, each protective film 10 is disposed correspondingly to cover each inlet 110, respectively, so as to filter out the moisture and the dust, but not limited thereto.

In some embodiments, the resonance plate 12 is made of a flexible material, but not limited thereto. The resonance plate 12 further has a central aperture 120 corresponding to the central cavity 111 of the gas inlet plate 11 that provides the gas for flowing through. In some other embodiments, the resonance plate is made of copper, but not limited thereto.

Figure 3A:
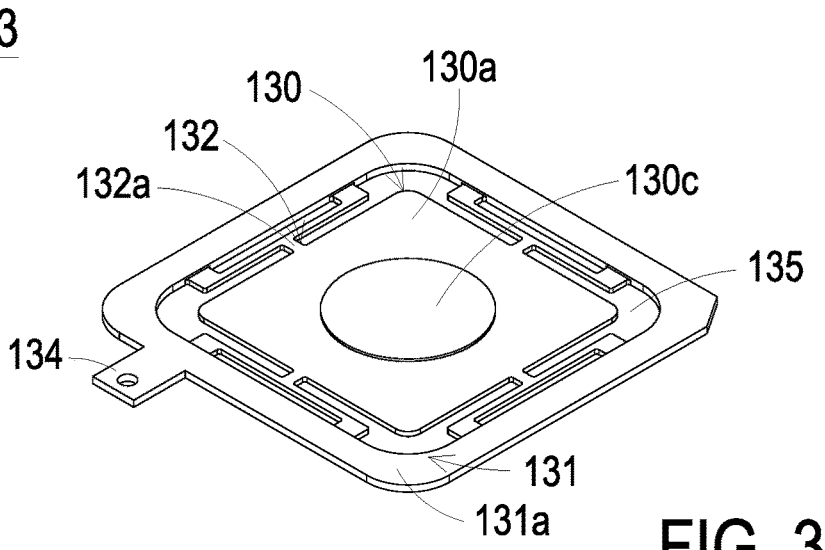
FIG. 3A is a schematic perspective view illustrating the piezoelectric actuator of the miniature gas control device of FIG. 1A and taken along the front side.
Figure 3B:
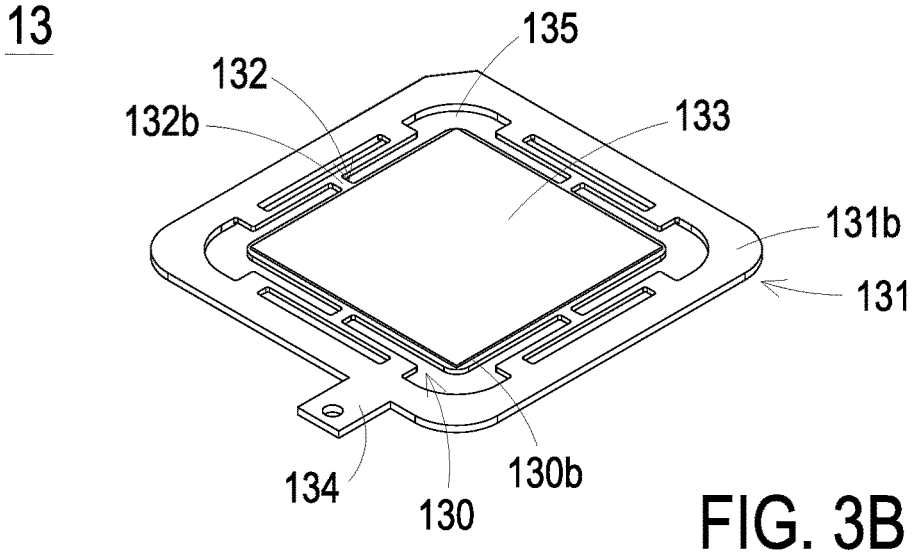
FIG. 3B is a schematic perspective view illustrating the piezoelectric actuator of the miniature gas control device of FIG. 1A and taken along the rear side.
Figure 3C:
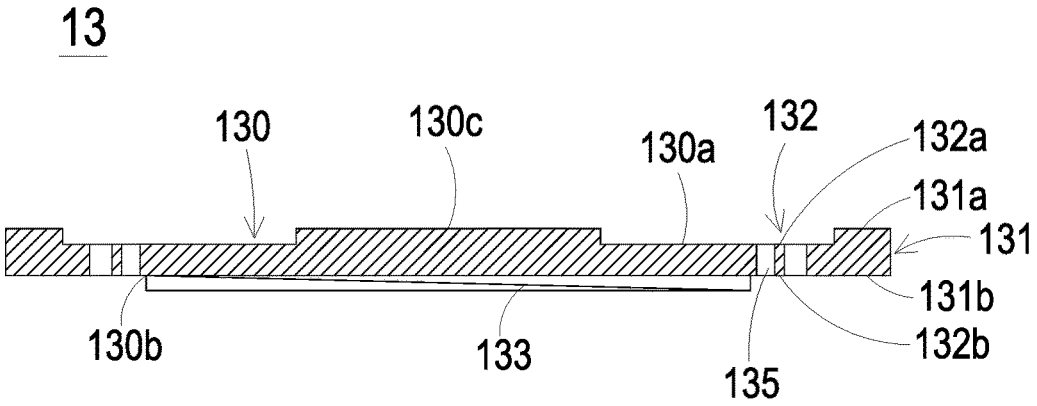
FIG. 3C is a schematic cross-sectional view illustrating the piezoelectric actuator of the miniature gas control device of FIG. 1A.

Please refer to FIGS. 3A to 3C. FIG. 3A is a schematic perspective view illustrating the piezoelectric actuator of the miniature gas control device of FIG. 1A and taken along the front side. FIG. 3B is a schematic perspective view illustrating the piezoelectric actuator of the miniature gas control device of FIG. 1A and taken along the rear side. FIG. 3C is a schematic cross-sectional view illustrating the piezoelectric actuator of the miniature gas control device of FIG. 1A. As shown in FIGS. 3A, 3B and 3C, the piezoelectric actuator 13 includes the suspension plate 130, the outer frame 131, a plurality of brackets 132, and the piezoelectric ceramic plate 133. The piezoelectric ceramic plate 133 is attached on a bottom surface 130*b* of the suspension plate 130. The plurality of brackets 132 are connected between the suspension plate 130 and the outer frame 131, while two ends of the bracket 132 are connected with the outer frame 131 and the suspension plate 130 respectively. At least one vacant space 135 is formed between the bracket 132, the suspension plate 130 and the outer frame 131 for allowing the gas to go through. The type of the suspension plate 130 and the outer frame 131 and the type and the number of the at least one bracket 132 may be varied according to the practical requirements. Moreover, a conducting pin 134 is protruding outwardly from the outer frame 131 for an electrical connection, but not limited thereto.

In this embodiment, the suspension plate 130 is a stepped structure. Namely, the suspension plate 130 includes a bulge 130*c* formed on a top surface 130*a* of the suspension plate 130. The bulge 130*c* can be but not limited to a circular convex structure. As shown in FIGS. 3A and 3C, a top surface of the bulge 130*c* of the suspension plate 130 is coplanar with a top surface 131*a* of the outer frame 131, while the top surface 130*a* of the suspension plate 130 is coplanar with a top surface 132*a* of the bracket 132. Moreover, there is a drop of specified amount from the bulge 130*c* of the suspension plate 130 and the top surface 131*a* of the outer frame 131 to the top surface 130*a* of the suspension plate 130 and the top surface 132*a* of the bracket 132. As shown in FIGS. 3B and 3C, a bottom surface 130*b* of the suspension plate 130, a bottom surface 131*b* of the outer frame 131 and a bottom surface 132*b* of the bracket 132 are coplanar with each other and form a flat plane. The piezoelectric ceramic plate 133 is attached on the bottom surface 130*b* of the suspension plate 130, namely the flat plane. In this embodiment, the suspension plate 130, the at least bracket 132 and the outer frame 131 are integrally formed by processing a metal plate, for example being made of as a stainless steel plate, but not limited thereto.

Figure 4:
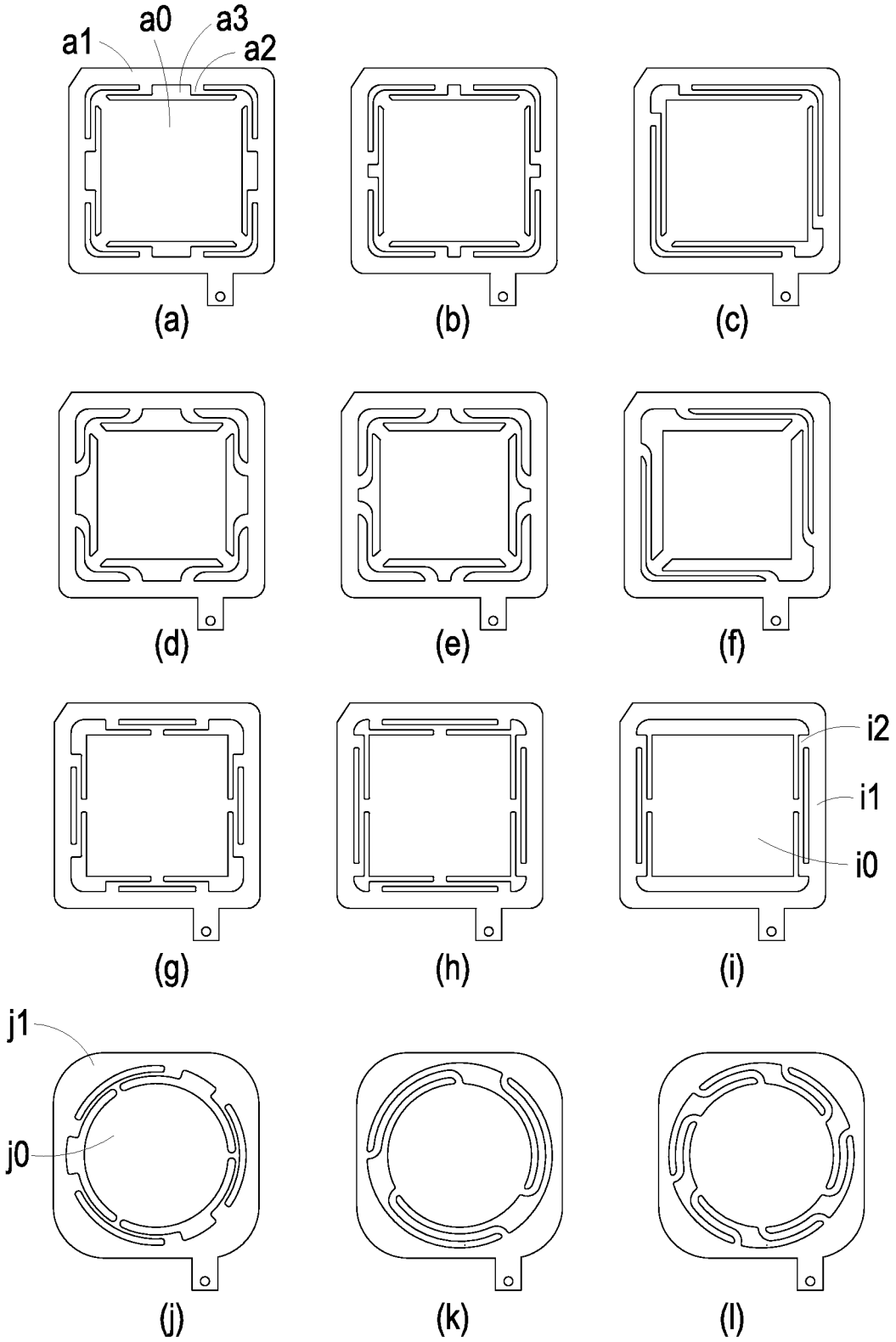
FIG. 4 schematically illustrates various exemplary piezoelectric actuator used in the miniature gas control device of FIG. 3A.

FIG. 4 schematically illustrates various exemplary piezoelectric actuator used in the miniature gas control device of FIG. 3A. As shown in the drawings, the suspension plate 130, the outer frame 131 and the at least one bracket 132 of the piezoelectric actuator 13 have various types, at least including the types (a)~(l) shown in FIG. 4. For example, in the type (a), the outer frame a1 and the suspension plate a0 are square, the outer frame a1 and the suspension plate a0 are connected with each other through for example but not limited to eight brackets a2, each two of which are disposed by one side of the square suspension plate a0. Several vacant spaces a3 are formed between the brackets a2, the suspension plate a0 and the outer frame a1 for allowing the gas to go through. In the type (i), the outer frame it and the suspension plate i0 are also square, but the outer frame i1 and the suspension plate i0 are connected with each other through merely two brackets i2. In each of the types (j)~(l), the suspension plate is circular, and the outer frame has a square with arc-shaped corners. For example, in the type (j), the suspension plate j0 is circular, and the outer frame has a square with arc-shaped corners, but not limited thereto. As mentioned above, the suspension plate 130 has a square or circular shape, and the piezoelectric ceramic plate 133 is attached on the bottom surface 130*b* of the suspension plate 130 also has the square or circular shape, but not limited thereto. Moreover, the number of the brackets 132 between the outer frame 131 and the suspension plate 130 may be varied according to the practical requirements. The suspension plate 130, the outer frame 131 and the at least one bracket 132 may be integrally formed with each other and produced by but not limited to a conventional machining process, a photolithography and etching process, a laser machining process, an electroforming process, an electric discharge machining process and so on, but not limited thereto.

Please refer to FIGS. 1A and 2A again. The miniature gas transportation device 1A further comprises the first insulation plate 141, the conducting plate 15 and the second insulation plate 142. The first insulation plate 141, the conducting plate 15 and the second insulation plate 142 are stacked on each other sequentially and located under the piezoelectric actuator 13. The profiles of the first insulation plate 141, the conducting plate 15 and the second insulation plate 142 substantially match the profile of the outer frame 131 of the piezoelectric actuator 13. The first insulation plate 141 and the second insulation plate 142 are made of an insulating material, for example as a plastic material, for providing insulating efficacy. The conducting plate 15 is made of an electrically conductive material, for example a metallic material, for providing electrically conducting efficacy. Moreover, the conducting plate 15 has a conducting pin 151 for an electrical connection, but not limited thereto.

Figure 5A:
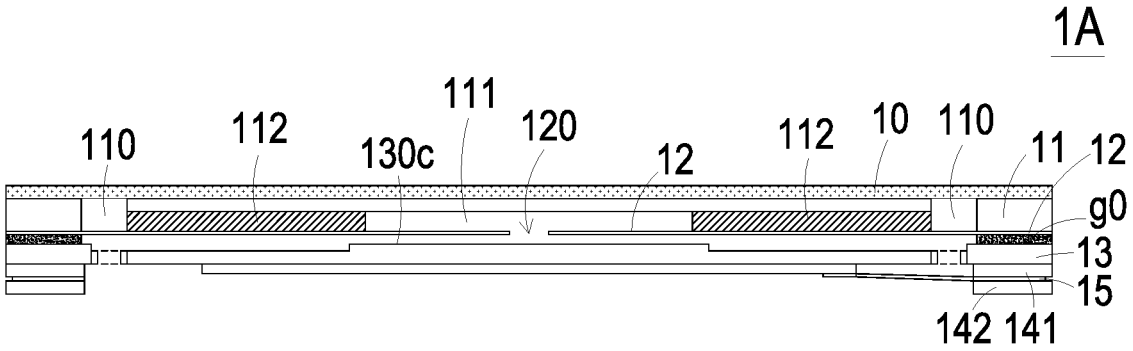
FIGS. 5A to 5E schematically illustrate the actions of the miniature gas transportation device of the miniature gas control device of FIG. 1A.

Please refer to FIGS. 1 and 5A to 5E. FIGS. 5A to 5E schematically illustrate the actions of the miniature gas transportation device of the miniature gas control device of FIG. 1A. As shown in FIG. 5A, the protective film 10, the gas inlet plate 11, the resonance plate 12, the piezoelectric actuator 13, the first insulation plate 141, the conducting plate 15 and the second insulation plate 142 of the miniature gas transportation device 1A are stacked on each other sequentially. Moreover, there is a gap g0 form between the resonance plate and the piezoelectric actuator 13. In the embodiment, the gap g0 between the resonance plate 12 and the outer frame 131 of the piezoelectric actuator 13 is formed and maintained by a conductive adhesive inserted therein, but not limited thereto. The gap g0 ensures the proper distance between the resonance plate 12 and the bulge 130*c* of the suspension plate 130, so that the contact interference is reduced and the generated noise is largely reduced. In some other embodiments, the outer frame 131 is produced to be at a level higher than the piezoelectric actuator 13, so that the gap is formed between the resonance plate 12 and the piezoelectric actuator 13, but not limited thereto.

Figure 7A:
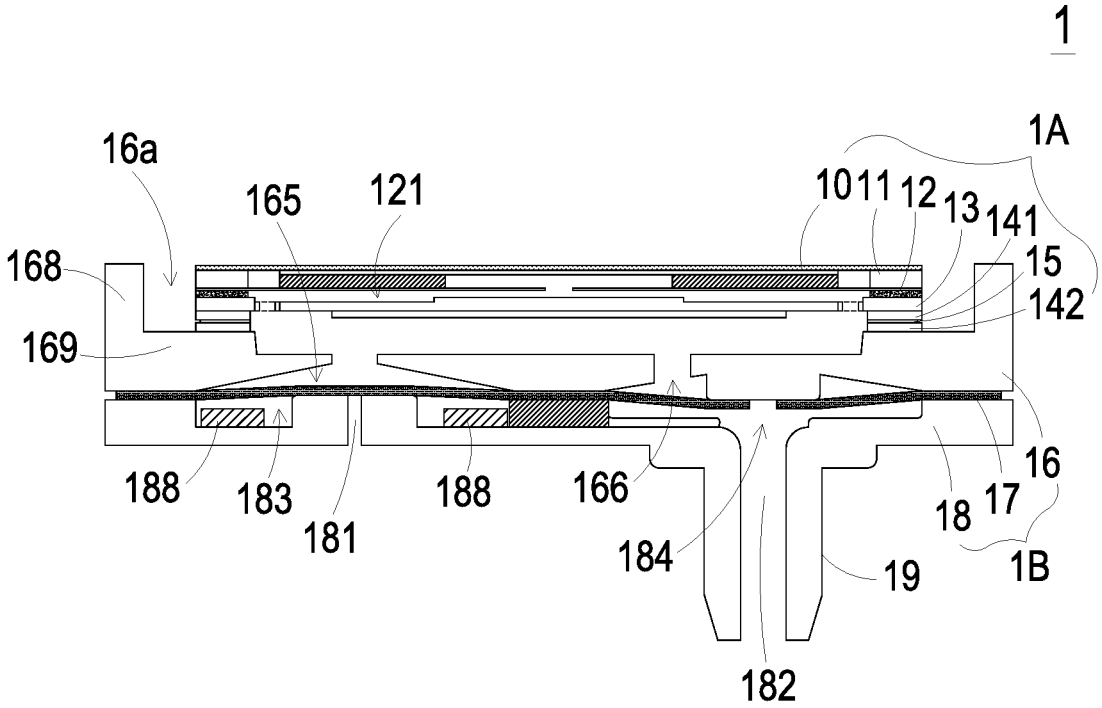
FIGS. 7A to 7E schematically illustrate the miniature gas control device of FIG. 1A performing the pressurizing operation.

Please refer to FIGS. 5A to 5E again. While the protective film 10, the gas inlet plate 11, the resonance plate 12 and the piezoelectric actuator 13 are stacked on each other sequentially and the inlets 110 of the gas inlet plate 11 are covered by the protective film 10, a convergence chamber is defined by the central aperture 120 of the resonance plate 12 and the central cavity 111 of the gas inlet plate 11 collaboratively for converging the gas. Moreover, a first chamber 121 is defined by the resonance plate 12 and the piezoelectric actuator 13 collaboratively for temporarily storing the gas. Meanwhile, the first chamber 121 is in communication with the convergence chamber at the central cavity 111 on the bottom surface of the gas inlet plate 11 through the central aperture 120 of the resonance plate 12. Meanwhile, the peripheral regions of the first chamber 121 are in communication with the underlying miniature valve device 1B through the vacant spaces 135 of the piezoelectric actuator 13 (as shown in FIG. 7A).

Figure 5B:
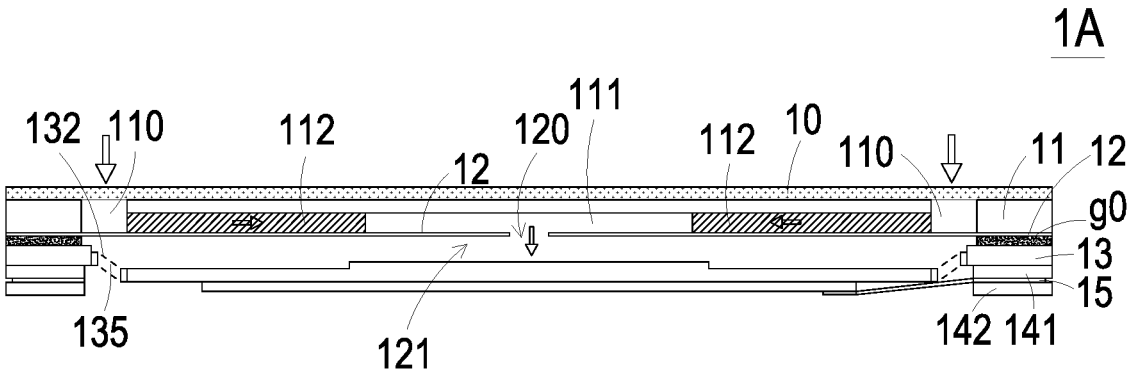
Figure 5C:
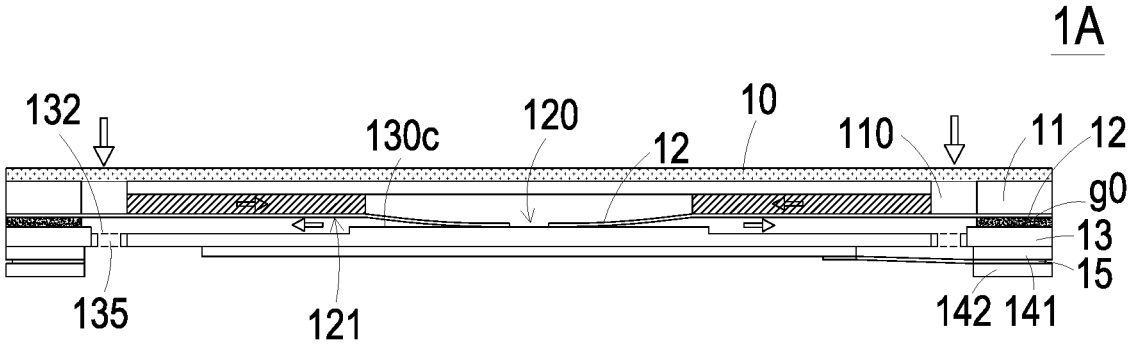
Figure 5D:
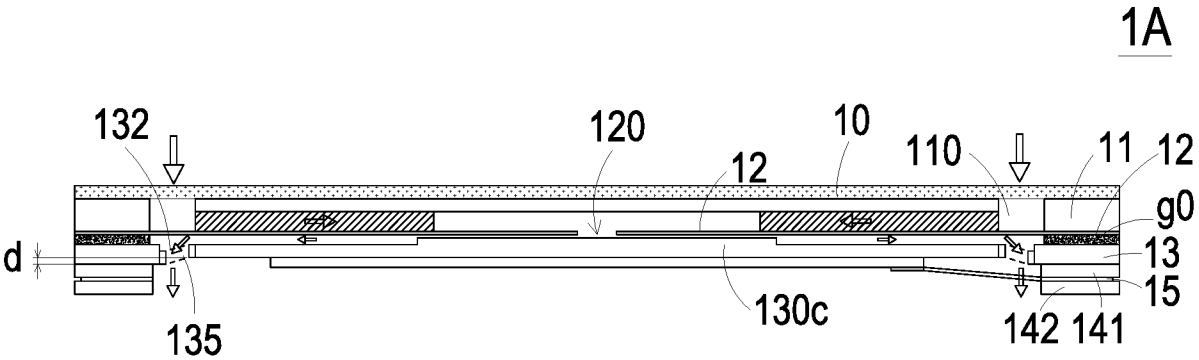
Figure 5E:
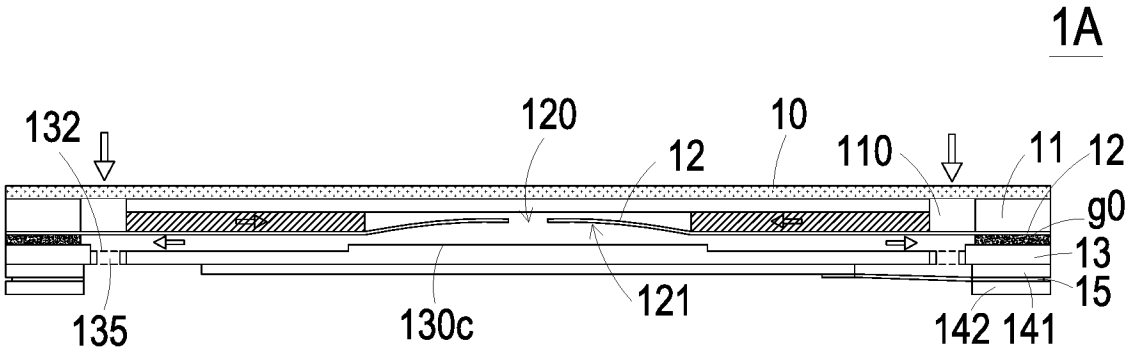

When the miniature gas transportation device 1A of the miniature gas control device 1 is enabled, the piezoelectric actuator 13 is actuated in response to an applied voltage. Consequently, the piezoelectric actuator 13 vibrates along a vertical direction in a reciprocating manner, while the brackets 132 are served as the fulcrums. As shown in FIG. 5B, the piezoelectric actuator vibrates downwardly in response to the applied voltage. After the gas is filtered by the protective film 10 to remove the moisture and the dust, the gas is fed into the at least one inlet 110 of the gas inlet plate 11. Then, the gas is converged to the central cavity 111 of the gas inlet plate 11 through the at least one convergence channel 112, and transferred downwardly to the first chamber 121 through the central aperture 120 of the resonance plate 12, which is relative to the central cavity 111. As the piezoelectric actuator 13 is enabled, the resonance of the resonance plate 12 occurs. Consequently, the resonance plate 12 vibrates along the vertical direction in the reciprocating manner. As shown in FIG. 5C, the resonance plate 12 vibrates downwardly, so as to contact and attach on the bulge 130*c* of the suspension plate 130 of the piezoelectric actuator 13. Owing to the deformation of the resonance plate 12 described above, a middle communication space of the first chamber 121 is closed, and the volume of the first chamber 121 is compressed. Under this circumstance, the pressure gradient occurs to push the gas in the first chamber 121 toward peripheral regions of the first chamber 121, and flowing downwardly through the vacant space 135 of the piezoelectric actuator 13. As shown in FIG. 5D, the resonance plate 12 returns to its original position when the piezoelectric actuator 13 deforms upwardly during the vibration. Consequently, the volume of the first chamber 121 is continuously compressed. Since the piezoelectric actuator 13 is ascended for a displacement d, the gas is continuously pushed toward peripheral regions of the first chamber 121. Meanwhile, the gas is continuously fed into the at least one inlet 110 of the gas inlet plate 11 through the protective film 10 to filter and transferred to the chamber formed by the central cavity 111. Then, as shown in FIG. 5E, the resonance plate 12 moves upwardly, which is cause by the resonance of upward motion of the piezoelectric actuator 13. Under this circumstance, the gas in the central cavity 111 is transferred to the first chamber 121 through the central aperture 120 of the resonance plate 12, then the gas is transferred downwardly through the vacant space 135 of the piezoelectric actuator 13, and finally the gas is exited from the miniature gas transportation device 1A. Consequently, a pressure gradient is generated in the flow channels of the miniature gas transportation device 1A to facilitate the gas to flow at a high speed. Moreover, since there is an impedance difference between the feeding direction and the exiting direction, the gas can be transmitted from the inlet side to the outlet side. Even if a gas pressure exists at the outlet side, the miniature gas transportation device 1A still has the capability of pushing the gas to the outlet side while achieving the silent efficacy.

In some embodiments, the vibration frequency of the resonance plate 12 along the vertical direction in the reciprocating manner is identical to the vibration frequency of the piezoelectric actuator 13. That is, the resonance plate 12 and the piezoelectric actuator 13 are synchronously vibrated along the upward direction or the downward direction. It is noted that numerous modifications and alterations of the actions of the resonance plate 12 and the piezoelectric actuator 13 may be made while retaining the teachings of the invention.

Figure 6A:
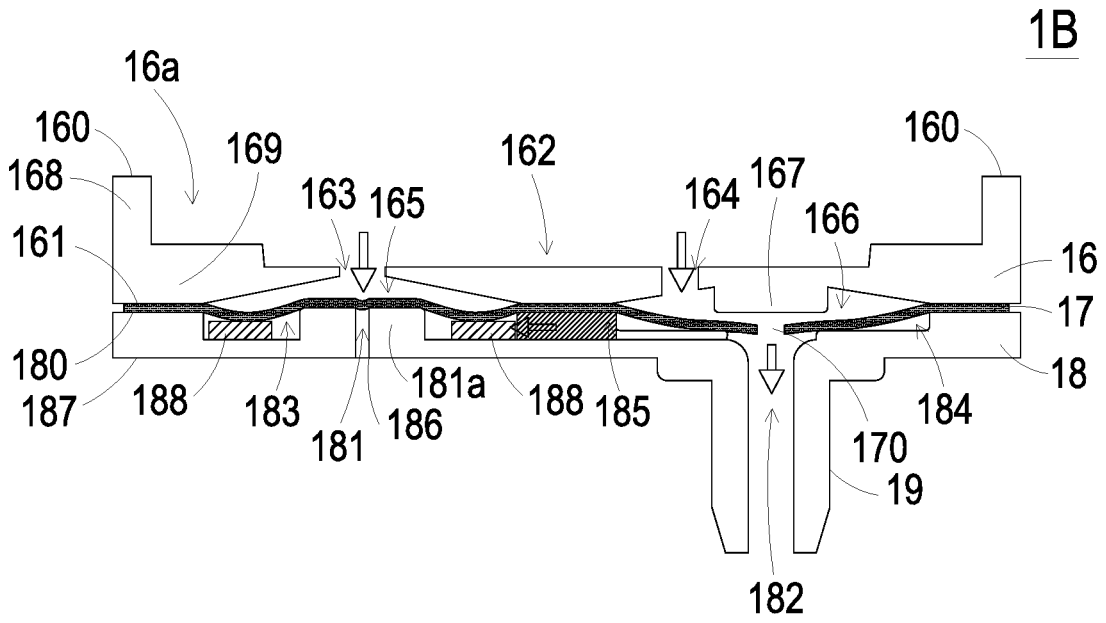
FIG. 6A schematically illustrates the miniature valve device of the miniature gas control device of FIG. 1A performing a pressurizing operation.
Figure 6B:
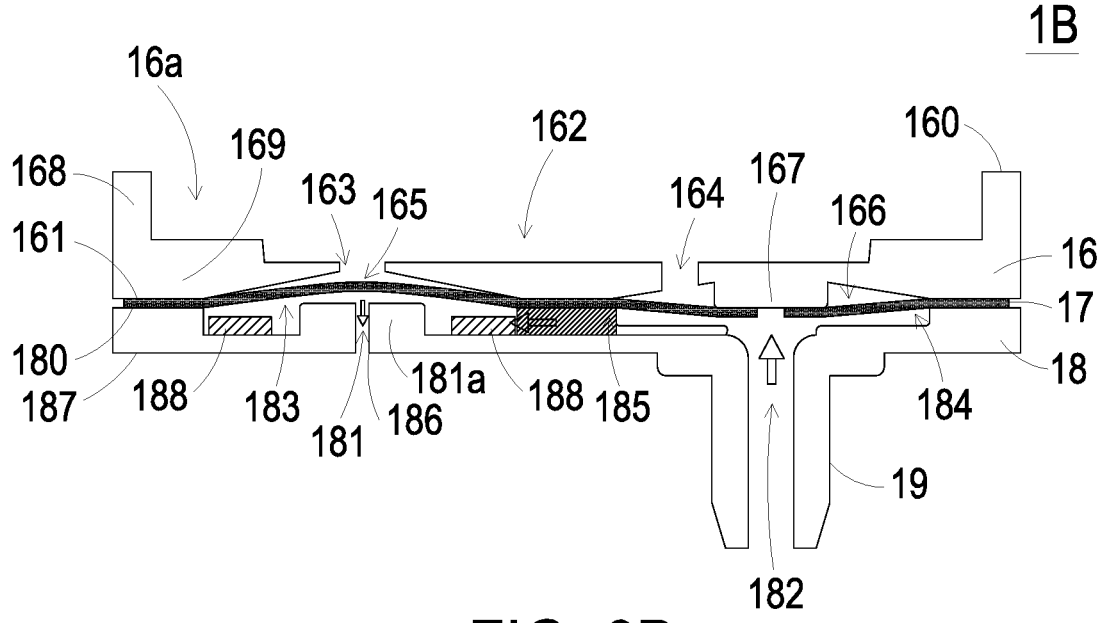
FIG. 6B schematically illustrates the miniature valve device of the miniature gas control device of FIG. 1A performing a pressure-releasing operation.

Please refer to FIGS. 1A, 2A, 6A and 6B. FIG. 6A schematically illustrates the miniature valve device of the miniature gas control device of FIG. 1A performing a pressurizing operation. FIG. 6B schematically illustrates the miniature valve device of the miniature gas control device of FIG. 1A performing a pressure-releasing operation. In the present embodiment, the miniature valve device 1B includes the gas collecting plate 16, the valve film 17 and the gas outlet plate 18 which are sequentially stacked. In the present embodiment, the gas collecting plate 16 has a fiducial surface 160 which is concaved to define a gas-collecting chamber 162. The gas that is transferred downwardly by the miniature gas transportation device 1A is temporarily accumulated in the gas-collecting chamber 162. The gas collecting plate 16 has a first perforation 163 and a second perforation 164. A first end of the first perforation 163 and a first end of the second perforation 164 are in communication with the gas-collecting chamber 162. A second end of the first perforation 163 and a second end of the second perforation 164 are in communication with a first pressure-releasing chamber 165 and a first outlet chamber 166, respectively, wherein the first pressure-releasing chamber 165 and the first outlet chamber 166 are concavely formed on a second surface 161 of the gas collecting plate 16. Moreover, the gas collecting plate 16 has a raised structure 167, which can be for example but not limited to a cylindrical structure. The raised structure 167 is disposed in the first outlet chamber 166 corresponding to the valve opening 170 of the valve film 17.

In the present embodiment, the gas outlet plate 18 includes a third perforation 181 and a fourth perforation 182, which are disposed corresponding to the first perforation 163 and the second perforation 164 of the gas collecting plate 16, respectively. The gas outlet plate 18 further includes a fiducial surface 180. On the fiducial surface 180 of the gas outlet plate 18, a place corresponding to the third perforation 181 is concaved to define a second pressure-releasing chamber 183, and a place corresponding to the fourth perforation 182 is concaved to define a second outlet chamber 184. The second pressure-releasing chamber 183 and the second outlet chamber 184 is in communication by a communication channel 185 for allowing the gas to go through. In the present embodiment, a first end of the third perforation 181 is in communication with the second pressure-releasing chamber 183, and a second end of the third perforation 181 is in communication with the pressure-releasing perforation 186 on the second surface 187 of the gas outlet plate 18. A raised structure 181*a* can be disposed around the first end of the third perforation 181. The raised structure 181*a* can be for example but not limited to a cylindrical structure. Meanwhile, a first end of the fourth perforation 182 is in communication with the second outlet chamber 184, and a second end of the fourth perforation 182 is in communication with the outlet structure 19. The outlet structure 19 may be connected with the target equipment (not shown), such as a press but not limited thereto.

The gas outlet plate 18 may further include one or more position-limiting structures 188. The number of the position-limiting structure 188 can be varied according to the practical requirements. In the present embodiment, there are two position-limiting structures 188 disposed within the second pressure-releasing chamber 183. Preferably but not exclusively, the position-limiting structures 188 have ring-shaped structures. While the miniature valve device 1B is performing the pressurizing operation, the position-limiting structure 188 can assist in supporting the valve film 17 and avoid collapse of the valve film 17. Consequently, the valve film 17 can be opened or closed more quickly.

In the present embodiment, the valve film 17 includes a valve opening 170 and plural positioning openings 171. After the valve film 17, the gas collecting plate 16 and the gas outlet plate 18 are combined together, the valve opening 170 is spatially corresponding to the raised structure 167 within the first outlet chamber 166 of the gas collecting plate 16. Due to such arrangement of the single valve opening 170, the gas flows unidirectionally in the miniature valve device 1B when there is a pressure difference.

Hereinafter, the pressurizing operation of the miniature valve device 1B will be illustrated with reference to FIG. 6A. The pressurizing operation of the miniature valve device 1B is activated in response to a force provided by the gas transferred downwardly from the miniature gas transportation device 1A (as shown in FIG. 7A) to the miniature valve device 1B, or is activated when the ambient air pressure is higher than the inner pressure of the target equipment (not shown). When the pressurizing operation of the miniature valve device 1B is activated, the gas is transferred from the miniature gas transportation device 1A to the gas-collecting chamber 162 of the miniature valve device 1B. Then, the gas is transferred downwardly to the first pressure-releasing chamber 165 and the first outlet chamber 166, through the first perforation 163 and the second perforation 164, respectively. In response to a force of the downwardly moving gas, the flexible valve film 17 is subjected to a downward curvy deformation. Consequently, the volume of the first pressure-releasing chamber 165 is expanded, and a part of the valve film 17 corresponding to the first perforation 163 is abutting against the first end of the third perforation 181 of the gas outlet plate 18 to make the third perforation 181 closed. Thus, the gas within the second pressure-releasing chamber 183 is not leaked out from the third perforation 181. Preferably, the gas outlet plate 18 has the raised structure 181*a* beside the first end of the third perforation 181. Due to the arrangement of the raised structure 181*a*, the valve film 17 abuts against the third perforation 181 more quickly and closes the third perforation 181 more effectively. Moreover, the raised structure 181*a* provides a pre-force to achieve a good sealing effect. Moreover, the position-limiting structure 188 is arranged around the third perforation 181 to assist in supporting the valve film 17 and avoid collapse of the valve film 17. On the other hand, when the gas is transferred downwardly to the first outlet chamber 166 through the second perforation 164, a part of the valve film 17 corresponding to the first outlet chamber 166 is also subjected to the downward curvy deformation in response to the force of the downwardly moving gas. Consequently, the valve opening 170 of the valve membrane 17 is opened downwardly. Under this circumstance, the gas is transferred from the first outlet chamber 166 to the second outlet chamber 184 through the valve opening 170. Then, the gas is transferred to the outlet structure 19 through the fourth perforation 182 and then transferred to the target equipment which is in communication with the outlet structure 19. Consequently, the pressurizing operation is performed and the target equipment is pressurized.

Hereinafter, the pressure-releasing operation of the miniature valve device 1B will be illustrated with reference to FIG. 6B. To activate the pressure-releasing operation, the user can adjust the gas transportation amount of the miniature gas transportation device 1A (as shown in FIG. 7A) to make the gas no longer transferred to the gas-collecting chamber 162. Alternatively, in case that the inner pressure of the target equipment (not shown) which is in communication with the outlet structure 19 is higher than the ambient air pressure, the pressure-releasing operation is also activated. When the pressure-releasing operation of the miniature valve device 1B is activated, the gas is transferred through the outlet perforation 182 which is penetrating the outlet structure 19 to the second outlet chamber 184. Consequently, the volume of the second outlet chamber 184 is expanded, and a part of the flexible valve film 17 corresponding to the second outlet chamber 184 is subjected to the upward curvy deformation. In addition, the valve film 17 is in close contact with the gas collecting plate 16. Consequently, the valve opening 170 of the valve film 17 is abutting against and closed by the gas collecting plate 16. Moreover, in the present embodiment, the gas collecting plate 16 has the raised structure 167 corresponding to the first outlet chamber 166. The raised structure 167 is improved to have an increased height and raised from the fiducial surface 160 of the gas collecting plate 16. Due to the arrangement of the raised structure 167, the flexible valve film 17 can be bent upwardly more quickly to reach an abutting state. Moreover, the raised structure 167 can provide a pre-force to achieve a good sealing effect on the closing valve opening 170. In an initial state of the pressure-releasing operation, the valve opening 170 of the valve film 17 is closed since it is closely contacted with and abutting against the raised structure 167. Thus, the gas in the second outlet chamber 184 will not be reversely returned to the first outlet chamber 166, and the efficacy of avoiding gas leakage is enhanced. Meanwhile, the gas in the second outlet chamber 184 flows to the second pressure-releasing chamber 183 through the communication channel 185, and the volume of the second pressure-releasing chamber 183 is expanded. Consequently, the part of the valve film 17 corresponding to the second pressure-releasing chamber 183 is also subjected to the upward curvy deformation. Since the valve film 17 is no longer in contact with the first end of the third perforation 181, the third perforation 181 is opened. Under this circumstance, the gas in the second pressure-releasing chamber 183 is outputted through the third perforation 181 and discharged from the pressure-releasing perforation 186, such that the pressure-releasing operation is performed. In the present embodiment, due to the convex structure 181*a* beside the third perforation 181 or the position-limiting structure 188 disposed within the second pressure-releasing chamber 183, the flexible valve film 17 can be subjected to the upward curvy deformation more quickly, which facilitates release of the flexible valve film 17 from the state closing the third perforation 181. The pressure-releasing operation in which the gas flows unidirectionally can discharge the gas within inner space of the target equipment (not shown), partially or completely. Under this circumstance, the gas pressure of the target equipment is reduced.

FIGS. 7A to 7E schematically illustrate the miniature gas control device of FIG. 1A performing the pressurizing operation. Please refer to FIGS. 1A, 2A and 7A to 7E. As shown in FIG. 7A, the miniature gas control device 1 includes the miniature gas transportation device 1A and the miniature valve device 1B. As mentioned above, the protective film 10, the gas inlet plate 11, the resonance plate 12, the piezoelectric actuator 13, the first insulation plate 141, the conducting plate 15 and the second insulation plate 142 of the miniature gas transportation device 1A are stacked on each other sequentially to be assembled. There is a gap g0 between the resonance plate 12 and the piezoelectric actuator 13. Moreover, the first chamber 121 is formed between the resonance plate 12 and the piezoelectric actuator 13. The miniature valve device 1B includes the gas collecting plate 16, the valve film 17 and the gas outlet plate 18, which are stacked on each other. The gas-collecting chamber 162 is arranged between the gas collecting plate 16 of the miniature valve device 1B and the piezoelectric actuator 13 of the miniature gas transportation device 1A. The first pressure-releasing chamber 165 and the first outlet chamber 166 are concavely formed on the second surface 161 of the gas collecting plate 16. The second pressure-releasing chamber 183 and the second outlet chamber 184 are concavely formed on the fiducial surface 180 of the gas outlet plate 18. Due to the arrangements of the above-mentioned pressure chambers cooperating with the actuation of the piezoelectric actuator 13, and the vibration of the plate 12 and the valve film 17, the gas is transferred downwardly in the transportation direction to pressurize.

Figure 7B:
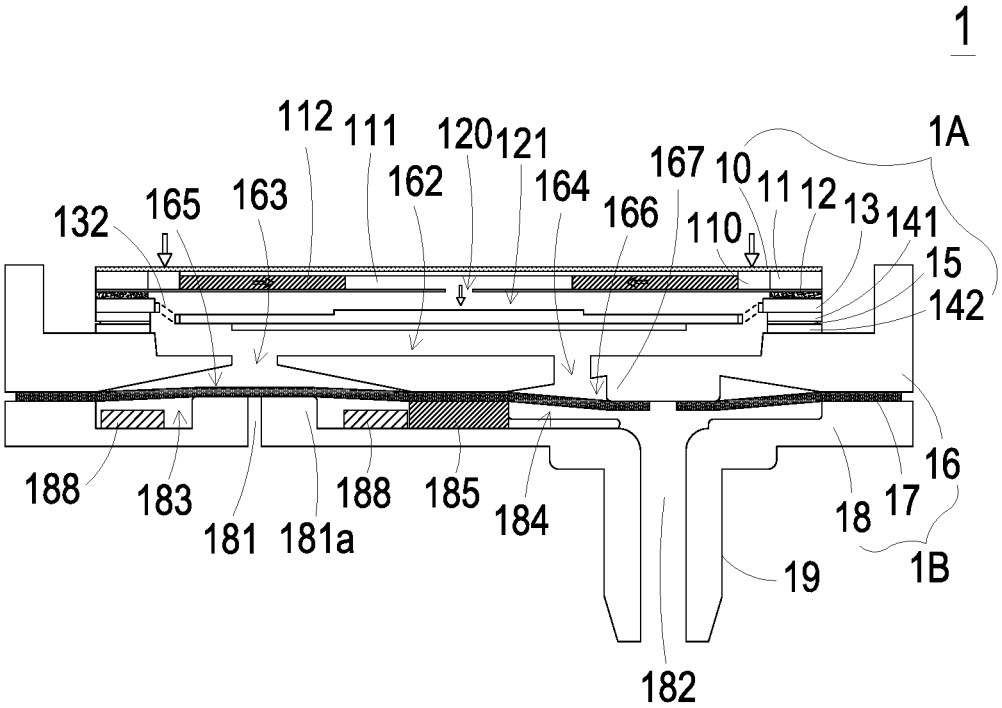
Figure 7C:
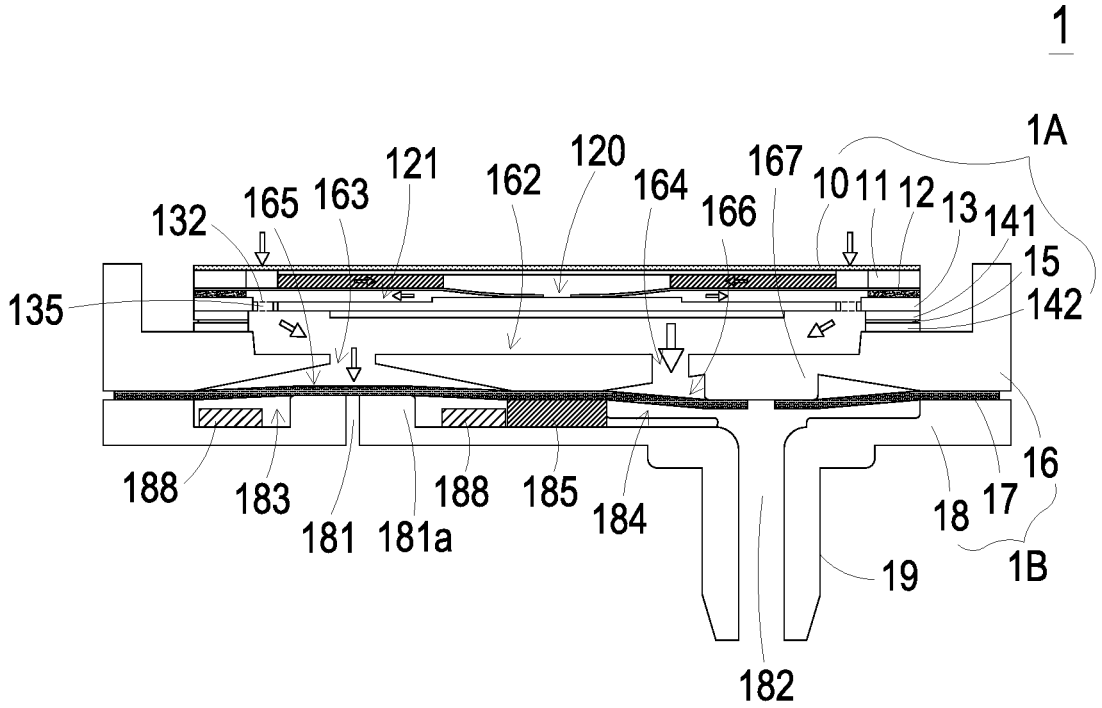

As shown in FIG. 7B, when the piezoelectric actuator 13 of the miniature gas transportation device 1A is vibrated downwardly in response to the applied voltage, the gas flows through the protective film 10 to be filtered firstly. Then, the gas is fed into the miniature gas transportation device 1A through the inlets 110 of the gas inlet plate 11, converged to the central cavity 111 through the at least one convergence channel 112 of the gas inlet plate 11, transferred through the central aperture 120 of the resonance plate 12, and introduced downwardly into the first chamber 121. Afterward, as shown in FIG. 7C, as the piezoelectric actuator 13 is actuated, the resonance of the resonance plate 12 occurs. Consequently, the resonance plate 12 is also vibrated along the vertical direction in the reciprocating manner. The resonance plate 12 is vibrated downwardly and contacted with the bulge 130*c* of the suspension plate 130 of the piezoelectric actuator 13. Due to the deformation of the resonance plate 12, the volume of the chamber corresponding to the central cavity 111 of the gas inlet plate 11 is expanded but the volume of the first chamber 121 is shrunken. Under this circumstance, the gas is pushed toward peripheral regions of the first chamber 121. Consequently, the gas is transferred downwardly through the vacant space 135 of the piezoelectric actuator 13. Then, the gas is transferred to the gas-collecting chamber 162 between the miniature gas transportation device 1A and the miniature valve device 1B. After that, the gas is transferred downwardly to the first pressure-releasing chamber 165 and the first outlet chamber 166 through the first perforation 163 and the second perforation 164, which are in communication with the gas-collecting chamber 162. It can be seen from this aspect of the present disclosure that when the resonance plate 12 is vibrated along the vertical direction in the reciprocating manner, the maximum vertical displacement of the resonance plate 12 is increased due to the gap g0 between the resonance plate 12 and the piezoelectric actuator 13. That is, due to the gap g0 between the resonance plate 12 and the piezoelectric actuator 13, the amplitude of the resonance plate 12 is increased when the resonance occurs.

Figure 7D:
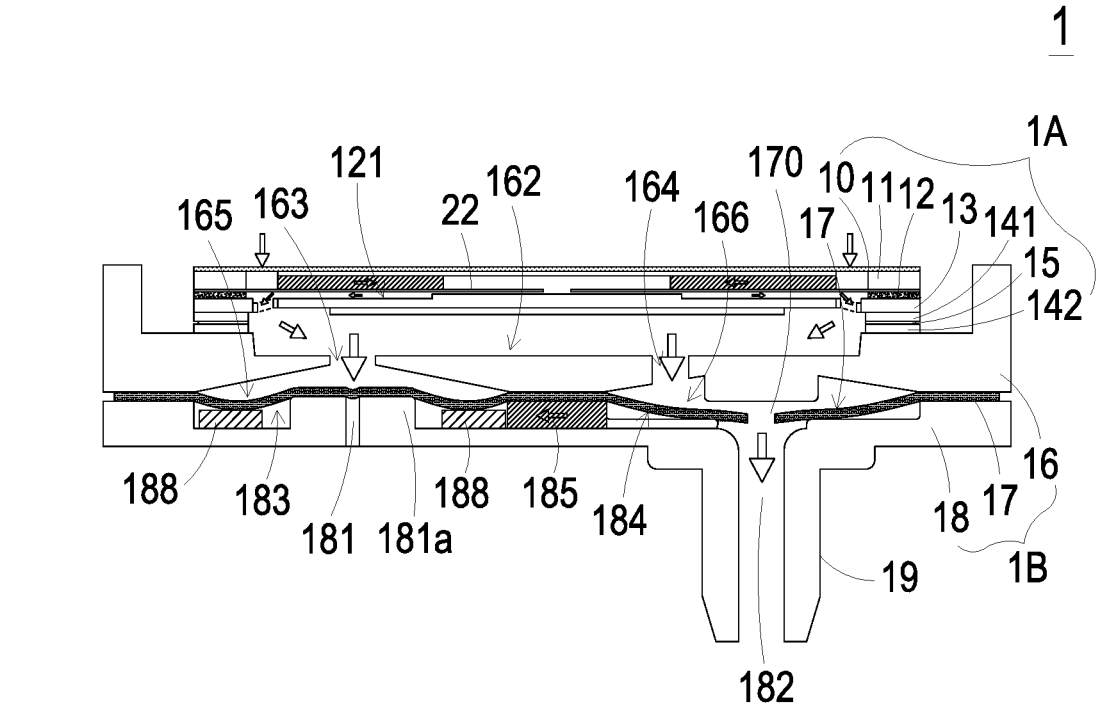
Figure 7E:
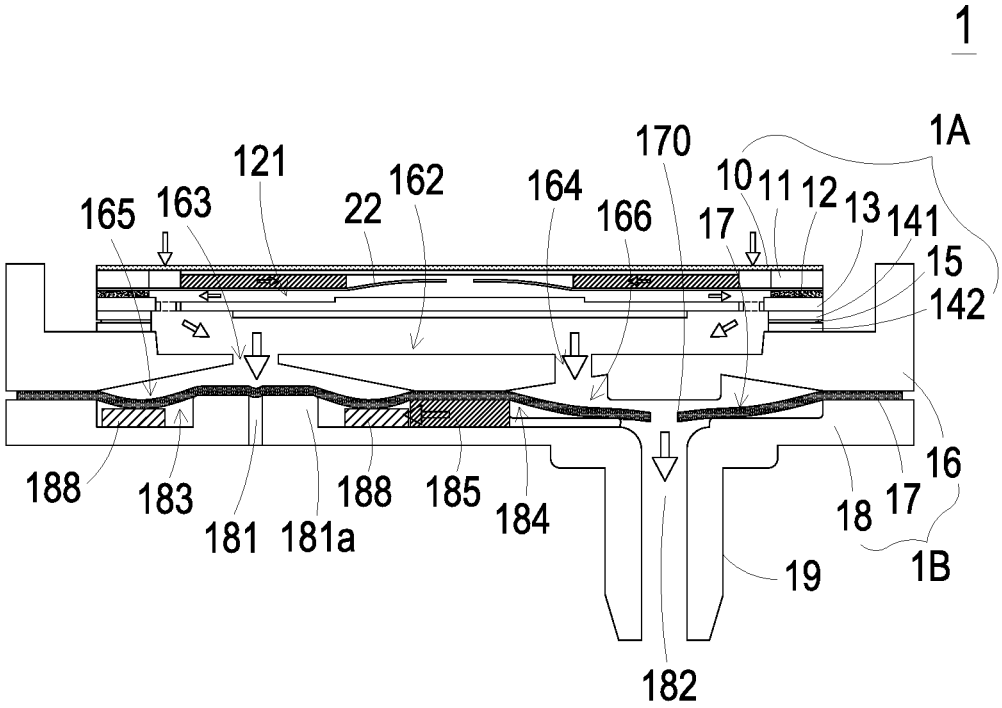

As shown in FIG. 7D, the resonance plate 12 of the miniature gas transportation device 1A is returned to its original position, and the piezoelectric actuator 13 is vibrated upwardly in response to the applied voltage. Consequently, the volume of the first chamber 121 is also shrunken, and the gas is continuously pushed toward peripheral regions of the first chamber 121. Moreover, the gas is continuously transferred from the vacant space 135 of the piezoelectric actuator 13 to the gas-collecting chamber 162, the first pressure-releasing chamber 165 and the first outlet chamber 166 of the miniature valve device 1B. Consequently, the gas pressure in the first pressure-releasing chamber 165 and the gas pressure in the first outlet chamber 166 are gradually increased. In response to the increased gas pressure, the flexible valve film 17 is subjected to the downward curvy deformation. Consequently, the part of the valve film 17 corresponding to the second pressure-releasing chamber 183 is moved downwardly and abutting against the raised structure 181*a* surrounding the first end of the third perforation 181. Under this circumstance, the third perforation 181 of the gas outlet plate 18 is closed. In the second outlet chamber 184, the valve opening 170 of the valve film 17 corresponding to the fourth perforation 182 is opened downwardly. Then, the gas within the second outlet chamber 184 is transferred downwardly to the outlet structure 19 through the fourth perforation 182 and then transferred to the target equipment (not shown) which is in communication with the outlet structure 19. Consequently, the inner space of the target equipment is pressurized, and the pressurizing operation is performed. Finally, as shown in FIG. 7E, the resonance plate 12 of the miniature gas transportation device 1A is vibrated upwardly. Under this circumstance, the gas in the central cavity 111 of the gas inlet plate 11 is transferred to the first chamber 121 through the central aperture 120 of the resonance plate 12, and then the gas is transferred downwardly to the miniature valve device 1B through the vacant space 135 of the piezoelectric actuator 13. As the gas is continuously transferred along the transportation direction to the gas-collecting chamber 162, the second perforation 164, the first outlet chamber 166, the second outlet chamber 184 and the outlet perforation 182 of the miniature valve device 1B, the gas is continuously transferred to the target equipment which is in communication with the outlet structure 19. This pressurizing operation may be triggered by the pressure difference between the ambient air pressure (e.g., atmospheric pressure) and the inner space of the target equipment, but not limited thereto.

Figure 8:
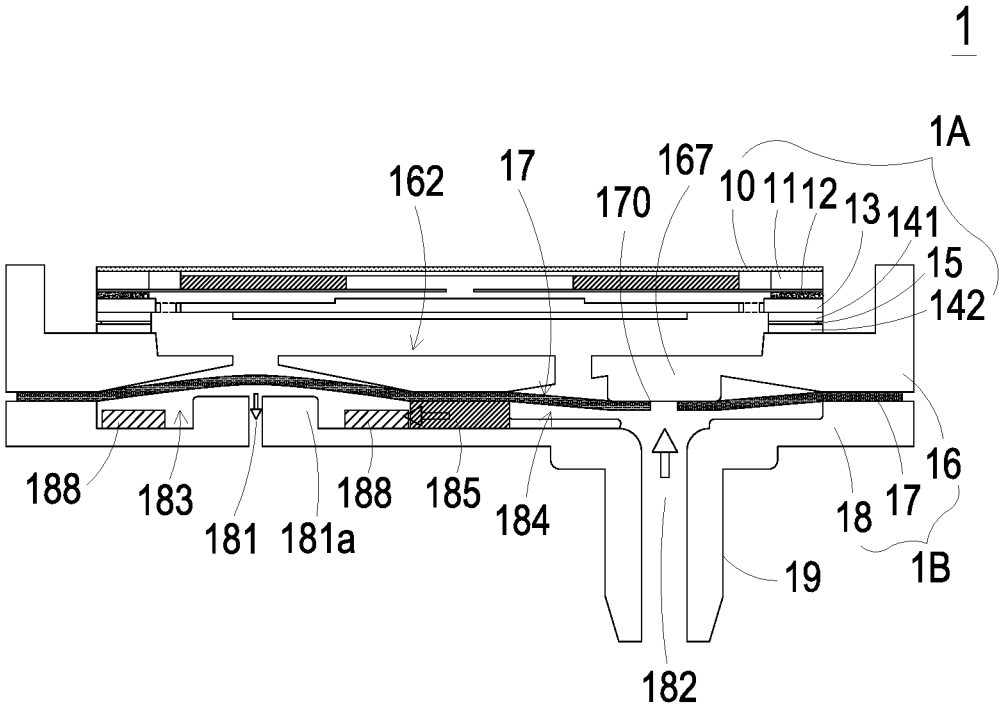
FIG. 8 schematically illustrates the miniature gas control device of FIG. 1A performing the pressure-releasing operation.

FIG. 8 schematically illustrates the miniature gas control device of FIG. 1A performing the pressure-releasing operation. When the inner pressure of the target equipment (not shown) connected to the outlet structure 19 is greater than the ambient air pressure, the miniature gas control device 1 performs the pressure-releasing operation to reduce the inner pressure of the target equipment. As mentioned above, the user may adjust the gas transportation amount of the miniature gas transportation device 1A to stop the gas from being transferred to the gas-collecting chamber 162. Under this circumstance, the gas is transferred from the outlet structure 19 to the second outlet chamber 184 through the outlet perforation 182 connected with the outlet structure 19. Consequently, the volume of the second outlet chamber 184 is expanded, and the part of the flexible valve film 17 corresponding to the second outlet chamber 184 is bent upwardly to abut against the raised structure 167 with the first outlet chamber 166. Since the valve opening 170 of the valve film 17 is closed by the raised structure 167, the gas in the second outlet chamber 184 will not be reversely returned to the first outlet chamber 166. Moreover, the gas in the second outlet chamber 184 is transferred to the second pressure-releasing chamber 183 through the communication channel 185, and then the gas is transferred to the pressure-releasing perforation 186 through the third perforation 181 to release the pressure. The unidirectional gas transportation implemented in the miniature valve device 1B discharges the gas within inner space of the target equipment (not shown) connected to the outlet structure 19, partially or completely, to decrease the inner pressure of the target equipment. Under this circumstance, the pressure-releasing operation is performed.

From the above descriptions, the present disclosure provides the miniature gas control device. The miniature gas control device is constructed by combining the miniature gas transportation device and the miniature valve device. After the gas is transferred through the protective film, the moisture and dust contained in the gas are removed by the first protective film. After the gas is filtered, the gas is fed into the miniature gas transportation device through the at least one inlet. When the piezoelectric actuator is activated, a pressure gradient is generated in the flow channels and the chambers of the miniature gas transportation device to facilitate the gas to transport to the miniature valve device at a high speed. Moreover, due to the one-way valve film of the miniature valve device, the gas is transferred in one direction. Consequently, the pressure of the gas is accumulated to any equipment that is connected with the outlet structure, which is referred to as the target equipment above. For performing a pressure-releasing operation or a pressure-reducing operation, the user may adjust the gas transportation amount of the miniature gas transportation device to stop the gas from being transferred to the gas-collecting chamber. Under this circumstance, the gas is transferred from the outlet structure to the second outlet chamber of the miniature valve device, then transferred to the second pressure-releasing chamber through the communication channel, and finally exited from the pressure-releasing perforation. By the miniature gas control device of the present disclosure, the gas can be quickly transferred while achieving silent efficacy. In addition, due to the arrangement of the protective film, it prevents the inner components from the damage and the rusty caused by the moisture or the accumulated dust. Consequently, the gas transportation efficiency is enhanced, and the gas outputted from the miniature gas transportation device can be dry and clean. It maintains the inner space of the equipment connected with the miniature gas transportation device to be dry and clean. Since the possibility of causing the damage of the miniature gas transportation device is reduced, the performance of the miniature gas transportation device is enhanced. Moreover, since the miniature gas control device is equipped with the miniature gas transportation device, the overall volume and thickness of the miniature gas control device are reduced. Consequently, the miniature gas control device is portable and suitable to be applied to medical equipment or any other appropriate equipment. In other words, the miniature gas control device of the present disclosure is industrially valuable.

While the disclosure has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A miniature gas control device, comprising:

a miniature gas transportation device comprising:

at least one protective film having a waterproof and dustproof film structure allowing gas to pass therethrough;

a gas inlet plate comprising at least one inlet, wherein the protective film is attached on a top surface of the gas inlet plate and completely covers the inlet of the gas inlet plate;

a resonance plate; and a piezoelectric actuator;

wherein the at least one protective film, the gas inlet plate, the resonance plate and the piezoelectric actuator are stacked on each other sequentially to be positioned, and a gap is formed between the resonance plate and the piezoelectric actuator to define a first chamber, wherein when the piezoelectric actuator is enabled, the gas is fed into the miniature gas transportation device through the at least one inlet of the gas inlet plate, transferred through the resonance plate, introduced into the first chamber, and further transferred along a transportation direction; and a miniature valve device comprising:

a gas collecting plate comprising at least two perforations and at least two chambers, wherein the gas collecting plate has a bottom plate and a sidewall protruding from peripheral edges of the bottom plate, wherein the miniature gas transportation device is located within an accommodation space formed by the sidewall and the bottom plate, a valve film comprising a valve opening; and a gas outlet plate comprising at least two perforations and at least two chambers;

wherein the gas collecting plate, the valve film and the gas outlet plate are stacked on each other sequentially to be positioned and a gas-collecting chamber is formed between the miniature gas transportation device and the miniature valve device, wherein after the gas is transferred from the miniature gas transportation device to the gas-collecting chamber along the transportation direction and fed into the miniature valve device, the gas flows unidirectionally in the at least two perforations and the at least two chambers of the gas collecting plate, and the at least two perforations and the at least two chambers of the gas outlet plate, wherein the valve opening of the valve film is opened or closed in response to the unidirectional flow of the gas, so that a pressurizing operation and a pressure-releasing operation is selectively performed.

2. The miniature gas control device according to claim 1, wherein the protective film complies with Rating IP64 of International Protection Marking (IEC 60529).

3. The miniature gas control device according to claim 1, wherein the protective film complies with Rating IP68 of International Protection Marking (IEC 60529).

4. The miniature gas control device according to claim 1, wherein the gas inlet plate further comprises at least one convergence channel and a central cavity, the at least one convergence channel is formed corresponding to the at least one inlet to guide the gas fed therein to be converged to the central cavity, wherein the resonance plate comprises a central aperture formed corresponding to the central cavity of the gas inlet plate, wherein the piezoelectric actuator comprises a suspension plate and an outer frame connected with each other by at least one bracket, and a piezoelectric ceramic plate is attached on a surface of the suspension plate.

5. The miniature gas control device according to claim 1, wherein the at least two perforations of the gas collecting plate are a first perforation and a second perforation, and the at least two chambers of the gas collecting plate are a first pressure-releasing chamber and a first outlet chamber, wherein the first perforation is in communication with the first pressure-releasing chamber, and the second perforation is in communication with the first outlet chamber.

6. The miniature gas control device according to claim 5, wherein the at least two perforations of the gas outlet plate are a third perforation and a fourth perforation, and the at least two chambers of the gas outlet plate are a second pressure-releasing chamber and a second outlet chamber, wherein the gas outlet plate further comprises a communication channel in communication between the second pressure-releasing chamber and the second outlet chamber.

7. The miniature gas control device according to claim 6, wherein the valve film is disposed between the gas collecting plate and the gas outlet plate and the valve opening of the valve film is arranged between the second perforation and the fourth perforation, wherein after the gas is transferred along the transportation direction from the miniature gas transportation device to the miniature valve device, the gas is introduced into the first pressure-releasing chamber through the first perforation and is introduced into the first outlet chamber through the second perforation, wherein the introduced gas flows into the fourth perforation through the valve opening to perform the pressurizing operation, wherein when the pressure of the pressurized gas is higher than the pressure of the introduced gas, the pressurized gas flows from the fourth perforation to the second outlet chamber to move the valve film, so that the valve opening of the valve film is abutting against the gas collecting plate to be closed, after which the pressurized gas is transferred from the second outlet chamber to the second pressure-releasing chamber through the communication channel while a part of the valve film in the second pressure-releasing chamber is moved, and the pressurized gas is discharged through the third perforation, so that the pressure-releasing operation is performed.

8. The miniature gas control device according to claim 1, wherein the gas inlet plate of the miniature gas transportation device is made of stainless steel.

9. The miniature gas control device according to claim 1, wherein the resonance plate of the miniature gas transportation device is made of copper.

10. The miniature gas control device according to claim 1, wherein the miniature gas transportation device further comprises at least one insulation plate and a conducting plate, wherein the at least one insulation plate and the conducting plate are sequentially disposed under the piezoelectric actuator.

11. The miniature gas control device according to claim 5, wherein the gas collecting chamber is in communication with the first perforation and the second perforation.

12. The miniature gas control device according to claim 5, wherein the first pressure-releasing chamber and the first outlet chamber of the miniature valve device are concavely formed on a surface of the gas collecting plate, wherein the surface of the gas collecting plate is opposite to another surface of the gas collecting plate that is facing the gas-collecting chamber.

13. The miniature gas control device according to claim 6, wherein the second pressure-releasing chamber and the second outlet chamber are formed on a surface of the gas outlet plate corresponding to the first pressure-releasing chamber and the first outlet chamber of the gas collecting plate, respectively.

14. A miniature gas control device, comprising:

at least one miniature gas transportation device comprising:

at least one protective film having a waterproof and dustproof film structure allowing gas to pass therethrough;

at least one gas inlet plate comprising at least one inlet, wherein the protective film is attached on a top surface of the gas inlet plate and completely covers the inlet of the gas inlet plate;

at least one resonance plate; and at least one piezoelectric actuator;

wherein the at least one protective film, the gas inlet plate, the resonance plate and the piezoelectric actuator are stacked on each other sequentially to be positioned, and at least one gap is formed between the resonance plate and the piezoelectric actuator to define at least one first chamber, wherein when the piezoelectric actuator is enabled, the gas is fed into the miniature gas transportation device through the at least one inlet of the gas inlet plate, transferred through the resonance plate, introduced into the first chamber, and further transferred along a transportation direction; and at least one miniature valve device comprising:

at least one gas collecting plate comprising at least two perforations and at least two chambers, wherein the at least one gas collecting plate has a bottom plate and a sidewall protruding from peripheral edges of the bottom plate, wherein the at least one miniature gas transportation device is located within an accommodation space formed by the sidewall and the bottom plate, at least one valve film comprising a valve opening; and at least one gas outlet plate comprising at least two perforations and at least two chambers;

wherein the gas collecting plate, the valve film and the gas outlet plate are stacked on each other sequentially to be positioned and at least one gas-collecting chamber is formed between the miniature gas transportation device and the miniature valve device, wherein after the gas is transferred from the miniature gas transportation device to the gas-collecting chamber along the transportation direction and fed into the miniature valve device, the gas flows unidirectionally in the at least two perforations and the at least two chambers of the gas collecting plate, and the at least two perforations and the at least two chambers of the gas outlet plate, wherein the valve opening of the valve film is opened or closed in response to the unidirectional flow of the gas to perform a pressurizing operation and a pressure-releasing operation selectively.

* * * * *